US009097142B2

(12) United States Patent
Adair et al.

(10) Patent No.: US 9,097,142 B2
(45) Date of Patent: Aug. 4, 2015

(54) ALIGNMENT OF STATIC PARTS IN A GAS TURBINE ENGINE

(75) Inventors: David Ronald Adair, Escondido, CA (US); Pete Simpson, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 599 days.

(21) Appl. No.: 13/488,562

(22) Filed: Jun. 5, 2012

(65) Prior Publication Data

US 2013/0323037 A1 Dec. 5, 2013

(51) Int. Cl.
*F01D 25/28* (2006.01)

(52) U.S. Cl.
CPC ..... *F01D 25/28* (2013.01); *F05D 2230/64* (2013.01); *Y10T 29/49778* (2015.01)

(58) Field of Classification Search
CPC ..... F01D 11/08; F01D 9/04; F01D 11/14; F01D 11/18; F05D 2230/64; F05D 2240/11; F05B 2230/604; F05B 2230/606
USPC ..... 415/134, 136, 182.1, 208.1, 211.2, 415/213.1, 214.1, 224, 224.5
See application file for complete search history.

(56) References Cited

U.S. PATENT DOCUMENTS

| | | | | |
|---|---|---|---|---|
| 4,307,993 | A * | 12/1981 | Hartel | 415/116 |
| 6,962,480 | B2 * | 11/2005 | Nguyen et al. | 415/108 |
| 8,684,689 | B2 * | 4/2014 | Guo et al. | 415/213.1 |
| 2011/0255959 | A1 * | 10/2011 | Klingler | 415/182.1 |
| 2011/0274538 | A1 * | 11/2011 | Shi et al. | 415/200 |
| 2012/0183394 | A1 * | 7/2012 | Guo et al. | 415/200 |
| 2013/0177413 | A1 * | 7/2013 | Klingler | 415/213.1 |

* cited by examiner

*Primary Examiner* — Dwayne J White
*Assistant Examiner* — William Grigos
(74) *Attorney, Agent, or Firm* — Kinney & Lange, P.A.

(57) ABSTRACT

A first structural static component having an outer diameter is aligned with a second structural static component having an inner diameter to the centerline of a gas turbine engine rotating assembly. The first static component is centered inside the second static component leaving a gap between the outer diameter of the first component and the inner diameter of the second component to permit them to mate at operating temperatures. Tabs and slots are placed on the periphery of the static components to align the static components with the centerline at build temperature.

18 Claims, 4 Drawing Sheets

ALIGNMENT OF STATIC PARTS IN A GAS TURBINE ENGINE

STATEMENT OF GOVERNMENT INTEREST

This invention was made with government support under [N00019-06-C-0081] awarded by U.S. Navy. The government has certain rights in the invention.

BACKGROUND

Alignment of the structural static components of a gas turbine engine to the centerline of its rotating assembly is critical to the performance and reliability of the engine. There have been two general ways to achieve this needed alignment.

One method is to use concentric diameters where one cylindrical face (the outer diameter or OD of the smaller part) fits into another cylindrical face (the inner diameter or ID of the larger part). This type of alignment is called a pilot. The advantage of the pilots is that they can center a part very precisely. The disadvantage is that the accuracy is dependent on the temperature and coefficient of thermal expansion for each material at build and all running conditions of the engine. Use of materials with significantly different coefficients of thermal expansion has not been possible using this alignment method because the gap between the ID and the OD is too large at start up, when the engine is cold. Thus, there is no alignment and the engine could fail.

The second method is the use of a radially instanced geometric feature, such as tabs and slots. The advantage of tabs and slots is that they can be employed under a wide range of temperatures and load conditions. The disadvantage is that this method is not as precise as the use of pilots due to manufacturing limitations. Especially with the use of materials with significantly different coefficients of thermal expansion, at operating temperatures, vibration and wear would cause the tabs to eventually fail.

Typically one or the other of the alignment methods is used for each component interface. The material and the temperature range of each component involved in the fit have, in the past, determined which of these two alignment methods is used. However, as noted above, neither is effective alone.

SUMMARY

It has now been discovered that gas turbine engines can be made and used with effective alignment between two materials having very dissimilar coefficients of thermal expansion using the method of this invention. For the first time it is possible to manufacture and use an engine with, for example, a titanium diffuser and a nickel alloy seal plate.

Specifically, the present invention comprises the use of both (1) a pilot alignment with a difference between the OD of the outer piece and the ID of the inner piece to be large enough so that under operating conditions at maximum operating temperatures, the OD and ID mate to provide complete alignment and (2) the use of tabs and slots to align the inner and outer piece during assembly and cold startup.

DETAILED DESCRIPTION

Figure 1:
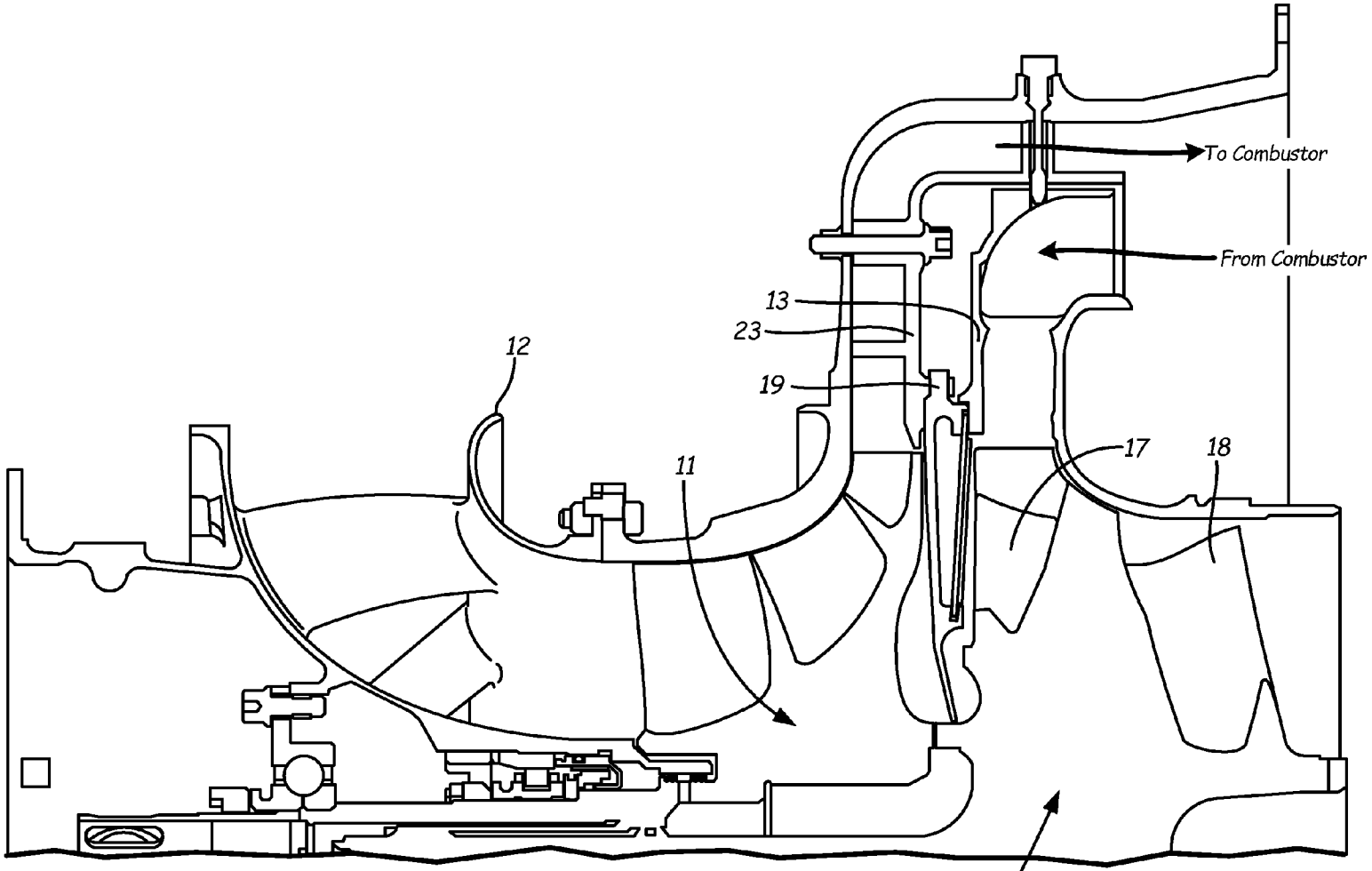
FIG. 1 is a section view of a gas turbine engine showing the relationship of static parts.

FIG. 1 illustrates an overview of the static structure that requires permanent alignment during startup at ambient temperature and also at maximum operating temperatures of a gas turbine engine. Shown is a conventional gas turbine engine with a compressor 11 for compressing air received at inlet 12 and delivering the compressed air to a combustor (not shown). The compressed air is combined with fuel in the combustor and ignited. The combustor gas produced in the combustor is delivered to turbine nozzle 13. The combustion gas passes through turbine 14, and causes rotation of turbine blades 17 and 18, and as a result the blades of compressor 11.

Turbine nozzle 13 is held in place by a seal plate 19 with pressure on nozzle 13. Seal plate 19 prevents combustion gases from returning to compressor 11.

A diffuser 23 locates the seal plate 19. Both seal plate 19 and diffuser 23 need to be concentric and aligned with the centerline of a gas turbine engine at all times and all temperatures, even though their coefficients of thermal expansion might be significantly different. Diffuser 23 serves to increase the pressure of the compressed air delivered to the combustor.

Figure 2:
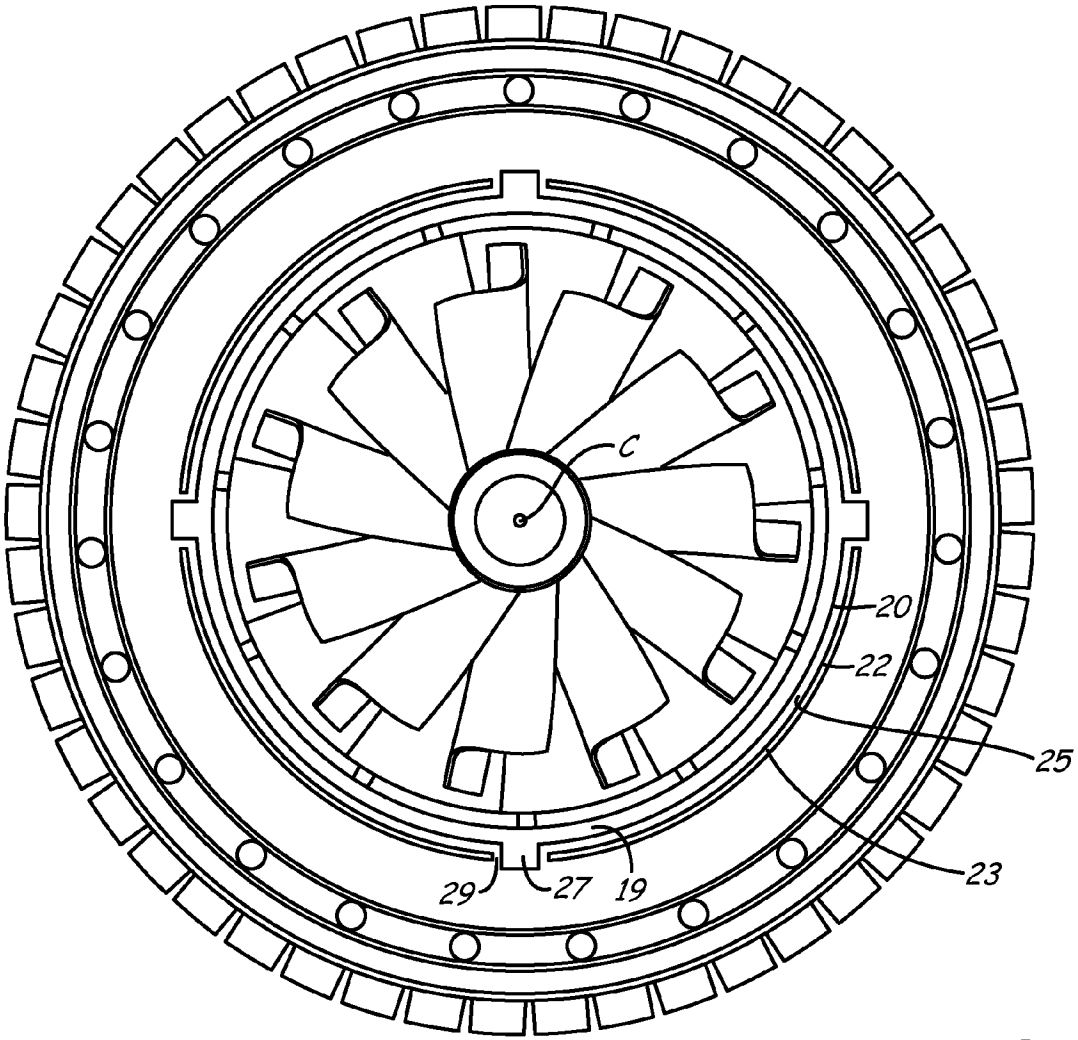
FIG. 2 is side sectional view of the alignment of a diffuser and a seal plate in a gas turbine engine.
Figure 3:
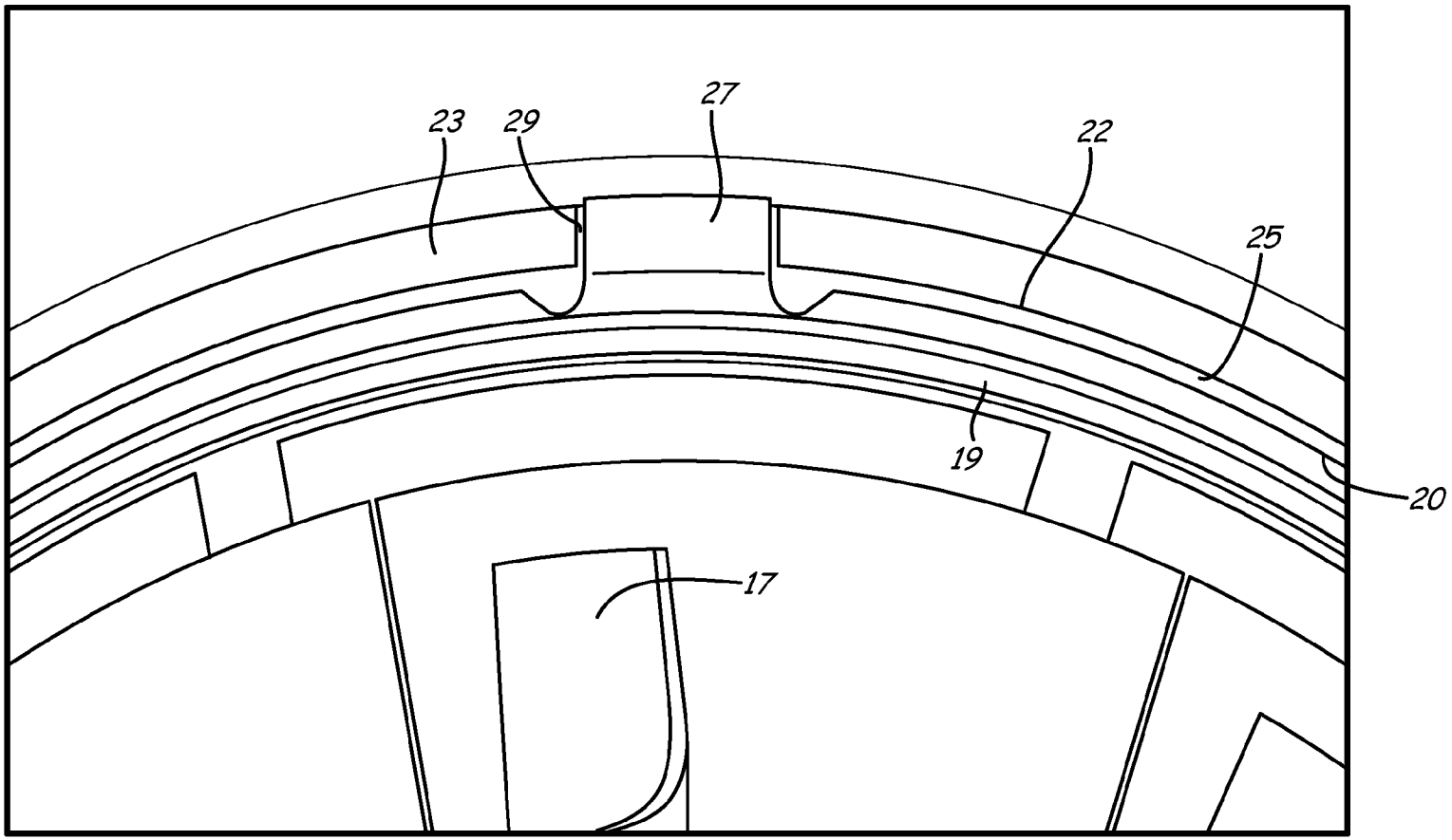
FIG. 3 is an enlarged sectional view showing the two alignment arrangements.
Figure 4:
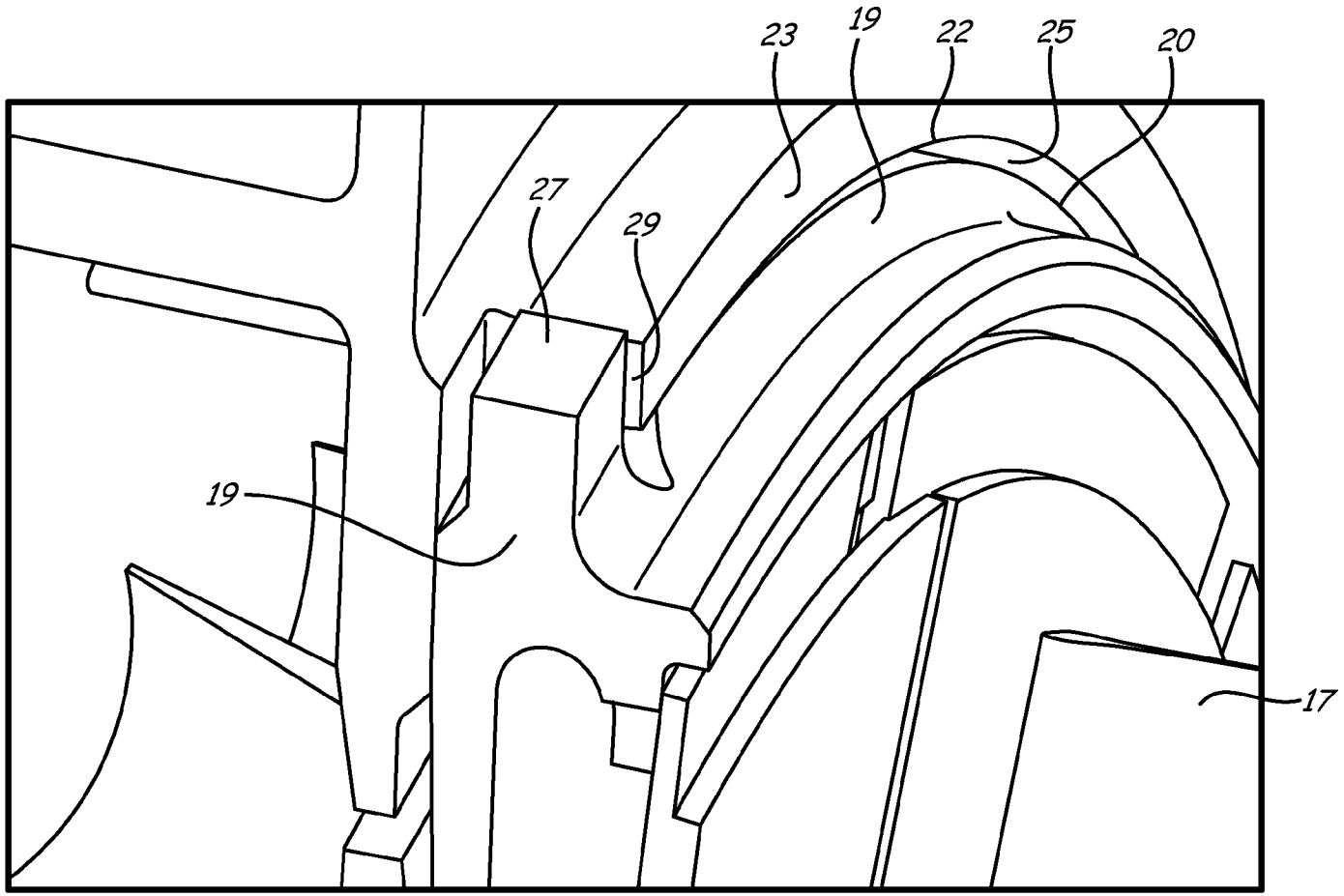
FIG. 4 is a further sectional view showing the relationship of the slot and tab arrangement.

FIG. 2 shows seal plate 19 with outer diameter 20 aligned and concentric with diffuser 23 with inner diameter 22 such that, at build temperature as shown in this view, there is a gap 25 between outer diameter 20 of seal plate 19 and inner diameter 22 of diffuser 23. Gap 25 allows for different materials to be used that have different coefficients of thermal expansion. At maximum operating temperature, outer diameter 20 of seal plate 19 and inner diameter 22 of the diffuser 23 are in direct contact so that gap 25 is gone, and seal plate 19 and diffuser 23 are mated in concentric alignment. FIG. 3 is an enlarged view of seal plate 19 and diffuser 23 so that gap 25 is more clearly visible.

Also shown in FIG. 2 are tabs 27, located at four locations circumferentially spaced on the periphery, in this example, that mate into slots 29. In FIG. 3, the build temperature has slot 29 holding tab 27 so that seal plate 19 and diffuser 23 are aligned and gap 25 can be seen. As the temperature is increased during operation of the engine, and gap 25 narrows until the seal plate OD and diffuser ID. mate. Thus the alignment of seal plate 19 and diffuser 23 is maintained regardless of the temperature of the two components.

The present invention has been shown to work with seal plates and diffusers of significantly different coefficients of thermal expansion, such as titanium and nickel alloy, both at ambient start up temperatures and at maximum operating temperatures. This allows manufacture and use of engines having less weight and lower cost while improving the alignment of the static components and thus the performance of the engine.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment(s) disclosed, but that the invention will include all embodiments falling within the scope of the appended claims.

The invention claimed is:

1. A method of aligning a first structural static component having an outer diameter with a second structural static component having an inner diameter to the centerline of a gas turbine engine rotating assembly, the method comprising:

centering the first structural static component inside the second structural static component leaving a gap between the outer diameter of the first structural static component and the inner diameter of the second structural static component, the gap sized to permit the outer diameter and the inner diameter to mate at operating temperatures; and positioning a plurality of tabs protruding from one of the structural static components into a mating plurality of slots that extend entirely through the other structural static component to align the structural static components with the centerline at build temperature, each mating tab and slot being aligned to permit closing of the gap during operation of the engine.

2. The method of claim 1, wherein the tabs protrude outward from the first structural static component having the outer diameter into the slots extending entirely through the second structural static component having the inner diameter.

3. The method of claim 1, wherein the plurality of tabs and slots comprises at least three tabs and three slots.

4. The method of claim 3, wherein the plurality of tabs and slots are circumferentially spaced around the periphery of the two structural static components.

5. The method of claim 1, wherein the structural static components are a seal plate and diffuser in a gas turbine engine.

6. The method of claim 1, where one structural static component has a larger coefficient of thermal expansion than the other structural static component.

7. An assembly of a first structural static component having an outer diameter and a second structural static component having an inner diameter such that both structural static components are aligned to the centerline of a gas turbine engine rotating assembly, the assembly comprising:

the first structural static component positioned within a portion of the second structural static component leaving a gap between the outer diameter and the inner diameter, the gap sized to permit the outer diameter and the inner diameter to mate at operating temperatures; and a plurality of tabs protruding from one of the structural static components into a mating plurality of slots extending completely through the other structural static component to align the structural static components with the centerline at build temperature, each mating tab and slot being aligned to permit closing of the gap during operation of the engine.

8. The assembly of claim 7, wherein the tab protrudes from the first structural static component and the slot extends completely through the second structural static component.

9. The assembly of claim 7, wherein the plurality of tabs and slots comprises at least three tabs and three slots.

10. The assembly of claim 9, wherein the plurality of tabs and slots are circumferentially spaced around the periphery of the two structural static components.

11. The assembly of claim 7, wherein the structural static components are a seal plate and diffuser in a gas turbine engine.

12. The assembly of claim 7, where one structural static component has a larger coefficient of thermal expansion than the other structural static component.

13. An gas turbine engine comprising:

a first static component with an outer diameter, the first static component having a plurality of tabs protruding radially outward from the outer diameter;

a second static component with an inner diameter, the second static component being radially outward from the first component and having a plurality of slots extending completely through the second static component on the inner diameter; and a gap between the outer diameter of the first static component and the inner diameter of the second static component, the gap sized to permit the outer diameter and the inner diameter to mate at operating temperatures, wherein the plurality of tabs protrude into the plurality of slots to align the first static component and the second static component with a centerline at build temperature and permit closing of the gap during operation of the gas turbine engine.

14. The gas turbine engine of claim 13, wherein the plurality of tabs and the plurality of slots comprises at least three tabs and three slots.

15. The gas turbine engine of claim 14, wherein the plurality of tabs and the plurality of slots are circumferentially spaced around the periphery of the two static components.

16. The gas turbine engine of claim 13, wherein the static components are a seal plate and diffuser in a gas turbine engine.

17. The gas turbine engine of claim 13, where one static component has a larger coefficient of thermal expansion than the other static component.

18. The gas turbine engine of claim 13, wherein the plurality of slots begin at the inner diameter of the second static component and extend to an outer diameter of the second static component.

* * * * *